United States Patent [19]

Hartman

[11] Patent Number: 4,681,237

[45] Date of Patent: Jul. 21, 1987

[54] METHOD FOR THE MANUFACTURE OF METAL PACKAGING CANS, AND A SEMI-PRODUCT IN THE MANUFACTURE OF SUCH CANS

[75] Inventor: Leo Hartman, Beverwijk, Netherlands

[73] Assignee: Hoogovens Groep B.V., Ijmuiden, Netherlands

[21] Appl. No.: 592,786

[22] Filed: Mar. 23, 1984

[30] Foreign Application Priority Data

Mar. 28, 1983 [NL] Netherlands ..... 8301069

[51] Int. Cl.[4] ..... B65D 6/34

[52] U.S. Cl. ..... 220/70; 72/330; 72/337; 220/66; 220/72; 220/DIG. 22; 413/69

[58] Field of Search ..... 220/DIG. 22, 66, 72, 220/70; 72/330, 337; 413/1, 69, 78; 29/415

[56] References Cited

U.S. PATENT DOCUMENTS

| | | | |
|---|---|---|---|
| B 223,678 | 3/1976 | Nixon et al. | 220/70 |
| 3,428,010 | 2/1969 | Frankenberg . | |
| 3,951,296 | 4/1976 | Swanson et al. | 220/DIG. 22 |
| 3,953,994 | 5/1976 | Brawner et al. . | |
| 4,320,848 | 3/1982 | Dye et al. | 220/DIG. 22 |

FOREIGN PATENT DOCUMENTS

| | | | |
|---|---|---|---|
| 752943 | 3/1953 | Fed. Rep. of Germany | 413/69 |
| 2140131 | 9/1972 | Fed. Rep. of Germany . | |
| 1211354 | 3/1960 | France . | |
| 2255976 | 12/1973 | France . | |
| 29537 | 2/1983 | Japan | 413/69 |
| 826883 | 1/1960 | United Kingdom . | |

*Primary Examiner*—Frederick R. Schmidt
*Assistant Examiner*—Robert Showalter
*Attorney, Agent, or Firm*—Stevens, Davis, Miller & Mosher

[57] ABSTRACT

In the manufacture of metal packaging cans metal sheet is deep-drawn and ironed to form a seamless tube having a bottom in one-piece therewith, and the tube is cut transversely to remove excess material at the end remote from the bottom. This forms a cylindrical body and bottom of a two-piece can. To minimize waste of material and to make possible the manufacture of a thin-walled three-piece can, the method includes cutting the deep-drawn and ironed tube transversely at at least one location intermediate the bottom and the end remote from the bottom so that, from the tube, there are formed a cylindrical body and bottom of a two-piece can and at least one cylindrical body of a three-piece can. Suitably, the tube is shaped by the deep-drawing and ironing so as to have a lesser wall-thickness at regions corresponding to the sidewalls of the cans and a greater wall-thickness at regions which correspond to the flange portions of the cans.

3 Claims, 4 Drawing Figures

METHOD FOR THE MANUFACTURE OF METAL PACKAGING CANS, AND A SEMI-PRODUCT IN THE MANUFACTURE OF SUCH CANS

BACKGROUND OF THE INVENTION

1. Field of the Invention

The invention relates to a method for the manufacture of metal packaging cans by deep-drawing and ironing of metal sheet, and also relates to a semi-product (i.e. an intermediate product) in the manufacture of metal packaging cans.

2. Description of the Prior Art

In the packaging industry, so-called two-piece and three-piece cans are well known. In the case of a two-piece can the cylindrical body and the bottom form one seamless unity, which is obtained by deep-drawing and subsequent ironing of metal sheet. The second part is the lid or top. In a so-called three-piece can on the other hand it is possible to distinguish a cylindrical body, a bottom and a lid or top, the three components being as a rule joined to each other by flanges.

Where a two-piece or a three-piece metal packaging can is mentioned herein, this should be taken as a reference to both the still lidless and the filled and closed can, unless otherwise stated.

In the packaging industry, two-piece and three-piece cans, each in various versions, have found their own areas of application, these being determined by the specific requirements of the packed product or by other circumstances such as transport costs, suitability for printing, unit cost, etc.

While the two-piece drawn and ironed can has a seamless body, the body of the three-piece can has a seam. This body is conventionally manufactured by rolling a flat sheet and subsequently joining the ends thereof to form the seam by soldering, cementing or welding. French patent specification No. 1,211,354 shows a can having two seams formed by superposing two sheets and seaming their edges together. An elongate tube divisible into several such cans is shown.

With a view to cost saving, there is a tendency with three-piece cans to move towards thinner material for the body, for example to reduce the wall thickness of the body from a conventional value of about 0.16 mm towards the wall thickness usual in ironed cans of about 0.10 mm.

To provide a good grasp of the various terms used it should be noted that by "deep drawing" (German "Tiefziehen") is intended in general, and in this specification, a process by which sheet material is deformed geometrically without significant change in the thickness of this material. In contrast to this, "ironing" (German "Abstrecken") implies a process by which the material is drawn between a matrix and a die with simultaneous drastic reduction of the wall thickness. In a standard deep-drawn and subsequently ironed drink can the bottom has still the thickness (about 0.30 mm) of the original material, while the wall is thinned to 0.10 mm. In this case, near the free end of this ironed can a larger wall-thickness is preserved, e.g. about 0.16 mm, in order to make easier the production of flanged edges for the fastening of the top.

If the shell of a three-piece can is to be given a wall-thickness comparable with that of a two-piece can, there remain considerable problems to be solved in the rolling of such super-thin plate of about 0.10 mm thickness, and during further processing. This thin material is very prone to kinking, so that extra care has to be given when transporting it, while during cutting of the plate not only is there a transport problem but the prevention or remedying of burr formation must be achieved. Consequently, extra care is necessary in order to shape this extra thin material into a cylinder and then to weld it. If soldering or cementing is used, this body has a disadvantage with respect to the two-piece ironed can, since the solder or cement material may make the can less suitable for various food stuffs and/or drinks. Special problems may also have to be solved when forming flanged edges from these extra thin-walled cylinders and subsequently fastening the bottom and lid to them, while achieving an adequate seal.

The latter problems are solved with two-piece ironed cans by the possibility during the ironing process of giving the material a greater thickness near the free end of the can, but this is not possible with the body of a three-piece can made from rolled material.

Nevertheless it appears that for certain applications three-piece cans still have advantages over two-piece cans, so that there is still a clear need for the development of a satisfactory method of making a thin-walled three-piece body.

It is mentioned here that U.S. Pat. No. 3,428,010 discloses a deep-drawn and ironed can which is made as a three piece can by cutting off and shaping the closed end of the drawn and ironed tube to provide the can top. The can bottom is provided by a conventionally flanged-on disc. This process involves a large number of steps.

It may be noted further that with two-piece cans there is a need to cut the end of the formed shell accurately to size (trimming), and at the same time the smoothest possible cutedge is required to be suitable as a flanged edge. With an ironed can this implies wastage at one end. This wastage is expensive.

SUMMARY OF THE INVENTION

The object of this invention is to provide a method of manufacture of cans in which all or some of the above problems are ameliorated, particularly a method which allows the production of cans using a reduced amount of material. Another object is to provide a process of producing a three-piece can with a thin-walled body.

The invention consists in a method in which by deep-drawing and ironing there is produced a semi-product which is a tube having a bottom in one-piece therewith which tube is then cut into (a) a two-piece can body and bottom and (b) at least one seamless three-piece can body. Preferably the semi-product has wall-portions of greater thickness at regions which are to be used for flanging in the cans formed from it and lesser thickness in the regions which form the body wall in the cans.

In particular, it is preferred if the semi-product has a wall-thickness of about 0.07–0.10 mm at the regions corresponding to the can body walls but which has thickened wall portions of about 0.12–0.20 mm in thickness at the regions corresponding to the flanging portions of the cans. These thickened regions preferably have an axial length of 7–20 mm for each flanging portion.

The manufacture of very elongated tubes with graduated wall thickness by deep-drawing and/or at least partial ironing is a well-known technique. What is new, according to the invention, is giving such a semi-product a shape such that several can bodies are produced by cutting several parts away, viz. a traditional two-piece body with a bottom and one or more bodies for three-piece cans. From the point of view of production technology there is here no especial difficulty in choosing the wall thickness or the body height for each of the constituent body sections in the semi-product differently, so that, for instance, it is possible to have a combination of an ironed two-piece body with one or more deep-drawn three-piece can bodies, or the combination of an ironed two-piece can body with one or more ironed three-piece can bodies. This choice can be wholly determined by market considerations which vary in time and place.

The three-piece can bodies produced by the method of the invention are subsequently provided with bottoms by flanging, e.g. by conventional processes. Both the three-piece cans and the two-piece cans are subsequently filled and provided with a top closure, as in conventional processes.

It is clear that by the method of the invention significant material savings are possible in comparison with conventional methods for the manufacture of bodies for two- and three-piece cans. Whereas in the conventional method using deep-drawing, each body is manufactured separately and must then be trimmed at the free end, resulting in wastage at one end for each can, in the new method it is only the semi-product which needs to be trimmed at the free end. There is no further wastage when the various body sections are produced by cutting up the semi-product.

An accompanying important advantage is that several can bodies are formed per stroke of the deep-drawing or ironing machine, against one body per stroke in the conventional method for the preparation of the two-piece cans. This makes possible a significant saving in investment costs and operating costs. As a rule cans must be lacquered internally before filling. In the method of manufacture of the invention, it is possible to lacquer the semi-product internally before separation of the can bodies. Thus two or more can bodies can be lacquered in a single operation.

An additional advantage obtainable with the new method is that it is possible to print on the exterior of the semi-product before the can bodies are separated. This also makes possible a saving in the number of operations.

It may be noted that the three-piece cans manufactured by this method are generally better suited for the packaging of foodstuffs and drinks, since no soldered, welded or cemented seam is present which is contacted by the can filling, or which contains a material which is deleterious to the can filling. Finally, since the can body does not need to be soldered or welded, no requirement has to be set for the solderability or weldability of the original material, and this gives the can-maker a greater freedom of choice for the can material or the coatings which have to be applied to it

BRIEF DESCRIPTION OF THE DRAWINGS

Further explanation of the invention, and description of a preferred non-limitative embodiment thereof will now be given by way of example with reference to the accompanying drawing, in which.

DESCRIPTION OF THE PREFERRED EMBODIMENT

Figure 1:
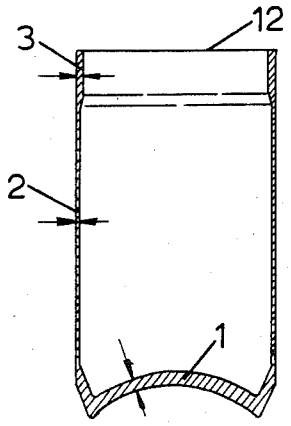
FIG. 1 shows in section a typical two-piece lidless can, before flanging of the free end.

The two-piece can formed by deep-drawing and ironing shown in FIG. 1 has a shape which is very generally used. For instance, the height may be 118 mm and the outside diameter 66 mm, the concave bottom 1 has here a thickness of 0.30 mm and the wall of the cylindrical body 3 has at the region 2 a thickness of 0.10 mm. The upper end of the body 3 has a wall-thickness of 0.16 mm, so that it is suitable for the formation of a flanged edge by which a lid with a thickness of 0.20 mm can be fastened. Although these dimensions can be different, these values characterise a very common type of two-piece steel can. The weight of such a can is about 30.1 g.

Figure 2:
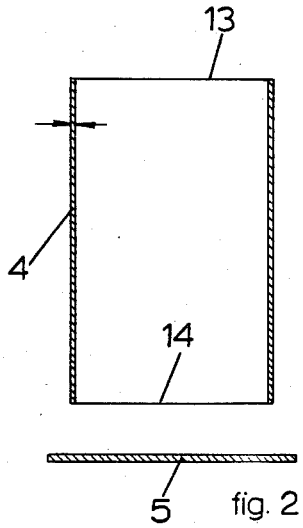
FIG. 2 shows the body and separately a bottom of a typical three-piece can, also before flanging of the ends.

FIG. 2 shows a body 4 and a bottom 5 of a common type of three-piece can, in which the body has a seam welded in a conventional manner. The body here has a height of 104 mm and an outside diameter of 66 mm while the disc which will form the bottom has a diameter of 83 mm and a thickness of 0.23 mm. The thickness of the wall 4 is, for cans of this type generally used, 0.155 mm or thicker. After they have been filled and fitted with lids, the cans in accordance with FIGS. 1 and 2 have the same diameter and same capacity (33 cl). The body and the bottom of the three-piece welded can according to FIG. 2 have, however, a weight of 38.9 g, so that this can is 8.8 g heavier than the ironed can of FIG. 1. In the production of these conventional cans the upper edge 12 of the can of FIG. 1 has to be trimmed to size, which involves some wastage.

Figure 3:
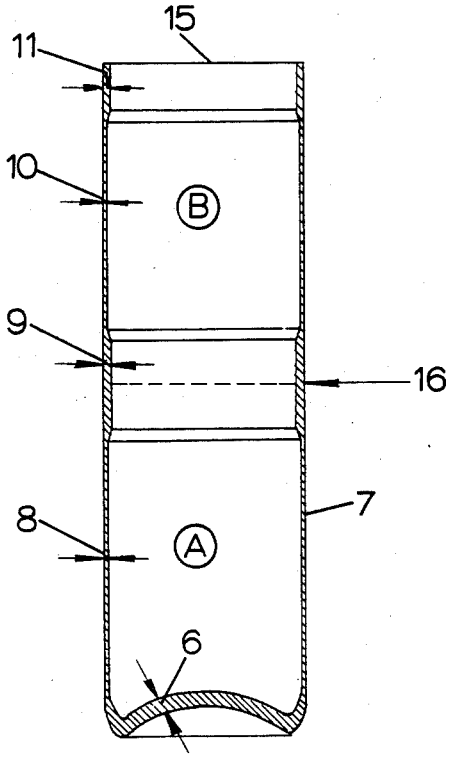
FIG. 3 is a drawing of a semi-product according to the invention from which a two-piece can and a body for a three-piece can are manufactured.

FIG. 3 shows a semi-product embodying the invention and illustrating a method embodying the invention. Cutting the semi-product at location 16 generates an ironed two-piece can body A with bottom 6 and an ironed can body B for a three-piece can. This semi-product is manufactured by deep-drawing and subsequent ironing in the same way in principle as the two-piece can of FIG. 1. The semi-product shown also has an outside diameter of 66 mm, but has a height of 222 mm, which corresponds to a height of 118 mm for can A and a height of 104 mm for can body B. The general dimensions of A and B thus correspond to those of the tubes according to FIG. 1 and FIG. 2. The shape and thickness of the bottom 6 are also chosen to be the same as those of the bottom 1 in FIG. 1. The wall 7, however, has in succession in the axial direction a wall section 8 with a thickness of 0.10 mm, a wall section 9 with a thickness of 0.16 mm, a wall section 10 with a thickness of 0.10 mm and a further wall section 11 with a thickness of 0.16 mm. When this semi-product is cut at the location 16, the can A is identical in form with the two-piece can of FIG. 1. The can body B on the other hand has the same external dimensions as the welded can body of FIG. 2 but, over the greater part of its length, the wall thickness is significantly less than that of the body of FIG. 2. Near the axial ends, however, the wall thickness at locations 9 and 11 is chosen to be thick enough so that flanged edges can be formed from it for the fitting of a bottom and a top.

After the ironing of the semi-product only one top edge 15 has to be trimmed. It is also clear from FIG. 3 that the semi-product is very suitable for internal lacquering and external printing before the can bodies A and B are separated at the location 16.

Although an embodiment is shown in FIG. 3 in which the semi-product constitutes only two can bodies, in the same manner several portions 9 can be produced in the cylindrical wall, so that several can shells can be cut from it. These may then be shorter than the can shell B, but it is also possible that the semi-product should be given an even greater length.

It is not essential that the can bodies A and B have the same wall thickness. One of them may be formed only by a single deep-drawing process, not followed by ironing, if the can body is intended for an application in which a high can strength is required.

Figure 4:
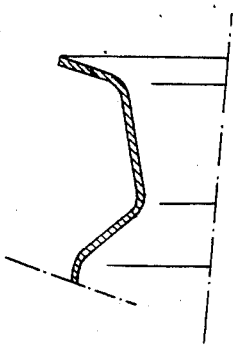
FIG. 4 shows on a larger scale a typical flanged edge of one-piece and two-piece cans.

Finally, FIG. 4 shows a flanged edge on an enlarged scale, which can be applied to both two-piece and three-piece cans. Deviations from the shape shown occur, but the exact nature of the flanged edge is not important to the invention.

What is claimed is:

1. In a method for the manufacture of steel metal packaging cans including the steps of deep-drawing and ironing steel metal sheet to form a seamless tube having a bottom in one-piece therewith, and cutting the tube transversely to remove excess material at the end remote from the bottom, thereby forming a cylindrical body and bottom of a two-piece can, the improvement of:

the further steps of (a) cutting the deep-drawn and ironed tube transversely at at least one location intermediate the bottom and the end remote from the bottom so that, from the tube, there are formed a cylindrical body and bottom of a two-piece can and at least one cylindrical body of a three-piece can, (b) securing a bottom to the or each said body of a three-piece can by flanging, said tube having alternating greater and lesser wall thicknesses, said lesser wall-thickness beiong at at least two regions corresponding to the side-walls of the cans and said greater wall-thickness being at at least two regions which correspond to the flange portions of the cans.

2. Semi-product in the manufacture of steel metal packaging cans, consisting of a seamless tube having at one end a bottom formed in one piece with the tube, the tube and bottom being obtained by deep-drawing and subsequent ironing of the tube over at least part of its length, said tube being of a length such that it constitutes, connected to each other, a cylindrical body and bottom of a two piece can and at least one cylindrical body of a three-piece can, wherein the wall-thickness of the tube is, adjacent the end remote from the bottom and at the or each location, of connection of two of said can bodies, greater than at other regions (excluding the bottom), the regions of greater thickness being suitable for the formation of flanged connections of top and, as appropriate, bottom walls of the cans.

3. Semi-product according to claim 2 wherein the wall-thickness of said regions of greater thickness is in the range 0.12 to 0.20 mm and the wall thickness at the other regions, excluding the bottom, is in the range 0.07 to 0.10 mm.

* * * * *